US006421938B1

(12) United States Patent
Kitanaka

(10) Patent No.: US 6,421,938 B1
(45) Date of Patent: Jul. 23, 2002

(54) ENDLESS CHAIN TYPE CUTTER

(75) Inventor: Katsumi Kitanaka, Tokyo (JP)

(73) Assignees: Kobe Steel, Ltd., Hyogo Pref.; Tomen Kenki Corporation, Osaka-Fu, both of (JP)

( * ) Notice: Subject to any disclaimer, the term of this patent is extended or adjusted under 35 U.S.C. 154(b) by 0 days.

(21) Appl. No.: 08/357,320

(22) Filed: Dec. 16, 1994

(30) Foreign Application Priority Data

Dec. 22, 1993 (JP) ..... 5-324545

(51) Int. Cl.[7] ..... E02F 3/14
(52) U.S. Cl. ..... 37/465; 37/352
(58) Field of Search ..... 37/465, 462, 189, 37/190, 352; 299/84.1, 34.01, 34.04, 82.1, 83.1

(56) References Cited

U.S. PATENT DOCUMENTS

| | | | | |
|---|---|---|---|---|
| 1,159,861 A | * | 11/1915 | Norris et al. | |
| 1,336,927 A | * | 4/1920 | Silvius | |
| 1,886,382 A | * | 11/1932 | Dunlap | 37/465 |
| 2,594,991 A | * | 4/1952 | Protzeller | 37/465 |
| 2,636,291 A | * | 4/1953 | Reagle | 37/465 |
| 2,666,273 A | * | 1/1954 | McIninch | 37/465 |
| 2,720,717 A | * | 10/1955 | Arps | 37/465 |
| 2,733,905 A | * | 2/1956 | Proctor | |
| 2,890,873 A | * | 6/1959 | Partington et al. | |
| 3,049,824 A | * | 8/1962 | McIninch | 37/465 |
| 3,152,412 A | * | 10/1964 | Benetti | 37/465 |
| 3,807,803 A | * | 4/1974 | Rollins et al. | |
| 3,913,979 A | * | 10/1975 | Strauss et al. | |
| 4,775,189 A | * | 10/1988 | Den Besten | 37/465 |
| 4,893,464 A | * | 1/1990 | Thuerman | 37/465 |
| 4,924,609 A | * | 5/1990 | Martin | |
| 5,248,188 A | * | 9/1993 | Walgren | |
| 5,257,471 A | * | 11/1993 | Kitanka | 37/465 |
| 5,525,114 A | * | 6/1996 | Gehrke | |
| 5,533,939 A | * | 7/1996 | Martin et al. | |

FOREIGN PATENT DOCUMENTS

| | | |
|---|---|---|
| AU | 540966 | 3/1982 |
| EP | 0522765 A2 | 1/1993 |
| GB | 164449 | 6/1921 |
| GB | 274217 | 7/1927 |

* cited by examiner

*Primary Examiner*—Victor Batson
(74) *Attorney, Agent, or Firm*—Stevens, Davis, Miller & Mosher, LLP

(57) ABSTRACT

An endless chain provided with groups of cutter elements thereon, for cutting a ditch in the ground, the cutter elements of each group, together being arranged to cut the ground throughout the width of the ditch. In excavating a ditch the cutter is advanced horizontally at a rate such that in the time the chain has moved a distance corresponding to the length of one group of cutter elements, the cutter has moved horizontally by less than the distance by which the cutter bits project from a base plate of the cutter element.

8 Claims, 5 Drawing Sheets

ENDLESS CHAIN TYPE CUTTER

The present invention relates to an endless chain type cutter for excavating a ditch in the ground for use when constructing an underground continuous wall in civil engineering works.

Previously, in order to construct an underground continuous wall, it was necessary to excavate an elliptical hole, 2 or 3 m (6 or 10 feet) wide, down to a predetermined depth from the ground surface, or to drill into the ground with an auger drill with double or triple lanes down to a predetermined depth, and then to insert a reinforcement cage or steel members. Finally, cement was poured into the hole, or ready mixed concrete was cast in the hole. By repeating this process with successive holes intercepting preceding ones, a continuous underground wall could be constructed.

In the prior method for constructing an underground continuous wall described above, there are some problems as follows. Since the machinery for excavating the holes is about 30 m (100 feet) tall, there is a danger that it may fall over. Secondly, the construction process is complicated, so-the construction period is prolonged. Also, a film of muddy water, bentonite or the like is formed where one hole intercepts the preceding section of wall, so a perfect joint cannot be made in order to form a continuous wall. Underground water may leak through the joints after completion of the works. It is therefore difficult to attain simultaneously the objectives of safely and rapidly constructing a wall in the ground which is also perfectly continuous.

Because of these problems, a method of making an underground continuous wall as shown in the schematic views of FIGS. 8 and 9 has been tried. In this method an endless chain type cutter c is disposed on one side of a self-propelled vehicle b having crawler tracks a. A continuous ditch is excavated in the ground by advancing the self-propelled vehicle b in the direction of the arrow A of FIGS. 8 and 9 while driving the cutter c. Then cement or concrete is poured into the ditch.

In the endless chain cutter c mentioned above, an endless chain f is spanned between upper and lower chain sprockets d and e and groups of cutter elements are disposed protrudingly on the outer side of this chain f at predetermined intervals. Within each group of cutter elements, cutter bits $g_1$–$g_9$ are arranged on base plates h, attached to the chain f, for example as shown in FIG. 10.

When the chain cutter having cutter bits $g_1$–$g_9$ as shown in FIG. 10 is advanced in the direction of the arrow A in FIGS. 8, 9 the sprockets d and e are rotated to drive the chain so that the cutter bits move in the upward or downward directions of the drawings. The excavating loci $i_1$–$i_9$ as shown by hatched lines in FIG. 10 are made on the ground in the upright face which is being cut in front of the cutter c. If the ground to be excavated is weak, then it can be efficiently excavated by the above-mentioned excavating loci $i_1$–$i_9$. However, in the case where the ground is hard and strong, there is a problem that the portions $j_1$–$j_7$ (see FIG. 10) of the ground in front of the cutter remain in place. When these remaining portions hit the outer surface of the base plate h or the endless chain f, these meet with increased resistance, so that the continuation of the excavating work is hampered.

The present invention aims to overcome this and other problems.

In the present invention there is provided an endless chain type cutter having an endless chain extending between upper and lower sprockets and at least one group of cutter elements thereon for use in cutting, in the ground, a ditch of pre-determined width, characterised by the cutter elements of each group, together, being arranged to cut the ground throughout the width between the laterally outermost cutter elements of the group.

With the invention, therefore, each group of cutter elements can cut each part of the ground in the width of the ditch being cut, ensuring that the ground is disturbed and loosened throughout the width of the ditch.

Typically, there are about ten elements in a group, and some elements are preferably of bucket type. The number of groups on the chain will depend on its length, but 4 to 8 groups may be typical.

The invention also provides apparatus for excavating a ditch including a vehicle, which is preferably a tracked vehicle, with such an endless chain type cutter mounted thereon.

The invention also provides a method of excavating a ditch using such an endless chain type cutter in which, in a time in which the endless chain moves along its path between the upper and lower sprockets by a distance corresponding to the length of a said group of cutter elements, the endless chain is advanced along the direction of the ditch being cut by a distance which is less than the distance by which the cutter elements project from the chain.

This method ensures that, even if the ground is hard and strong the chain itself will not engage the ground being cut.

The invention will be further understood from the following description, when taken together with the attached drawings, which are given by way of example only, and in which.

An embodiment of the present invention is described hereinafter with reference to FIGS. 1 to 7.

Figure 1:
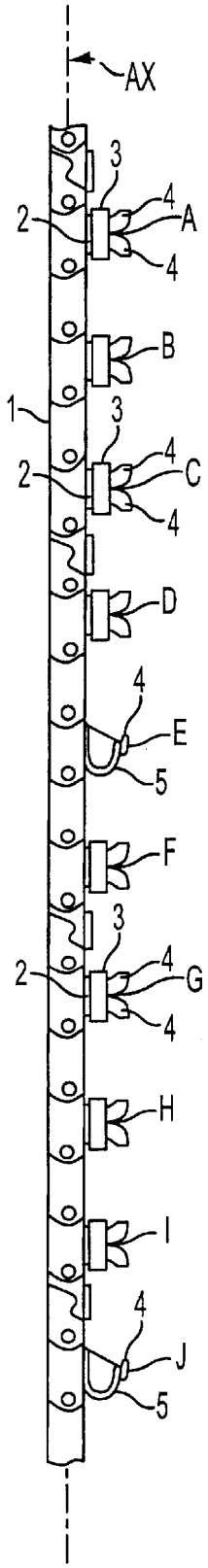
FIG. 1 is a side view showing part of an endless chain type cutter according to the present invention with a group of cutter elements thereon.

FIG. 1 is a side view showing part of an endless chain of an endless chain type cutter according to the present invention, in which reference numeral 1 denotes the endless chain.

In the present embodiment, there are provided groups of different kinds (in this embodiment, 10 kinds A–J) of cutter elements attached to an endless chain 1. In this embodiment there are ten elements, A–J, in the group. These cutter elements A–J are arranged on the outside of the endless chain 1 at appropriate intervals.

FIG. 1 therefore presents an overall view of typical segment of the endless chain, and of the various types of cutter elements and their respective groupings on the endless chain. That is, FIG. 1 serves to illustrate that in a typical embodiment, a segment of the chain comprises a grouping of cutter elements of the general type A, B, C, and D, followed by a cutter element of the type E (i.e., a bucket type), then another grouping of the cutter elements of the general type F, G, H, and I, followed by a cutter element of the type J (i.e., another embodiment of the bucket type). Details of the individual cutter elements, however, are provided in the other drawings, such as FIGS. 2*a–c*.

Figure 2A:
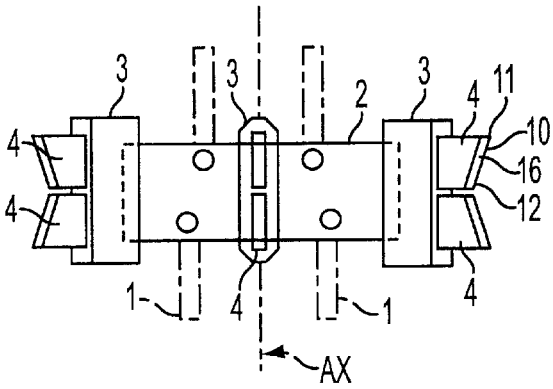
FIG. 2 shows at (a) a front view of one example of a cutter element, and at (b) and (c) plan and side views of that element.
Figure 2B:
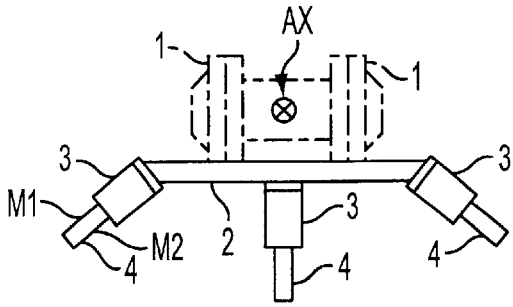

FIGS. 2*a, b*, and c show the cutter element A in which the cutter bit depicted is another embodiment of that depicted in FIG. 1. The cutter element A of FIGS. 2*a–c* has a planar configuration (i.e., the surface 16 of each cutting edge 10 has a planar configuration) which is oriented substantially parallel to the axis AX along which the chain extends. In FIGS. 2*a–c*, 2 is a base plate, 3 is a cutter bit holding member disposed protrudingly on the base plate 2 at a predetermined position and a predetermined angle, and 4 are cutter bits disposed protrudingly on these cutter bit holding members FIG. 2*b* is a schematic representation of the base plate 2 and cutter bit holding members 3. The plan view of FIG. 2*b* depicts the orientation of the cutter bit holding members 3 relative to the plane of the base plate 2, but is not intended to depict the details of the cutter bits 4, which details are presented in FIGS. 2*a* and 2*c*.

As depicted in FIG. 2*a*, for example, the cutter element comprises cutting bit 4 which comprises a cutting edge 10 which has a beveled cutting edge surface 16. Cutting edge 10 and surface 16 are comprehended within the aforementioned planar configuration. Cutting edge surface 16 comprises cutting edge tip 11 and cutting edge tip 12. The cutting edge surface 16 of each cutter bit 4 is oriented so as to be substantially parallel to the axis AX along which the chain extends. That is, for example, as endless chain 1 moves upward through the soil, the cutting edge surface 16 including cutting edge tip 11 and cutting edge tip 12 moves in a parallel manner upward through the soil in a "slicing" action. Although the cutting edge 10 of cutter bit 4 in FIG. 2*a* is depicted as being angled (i.e., angled from cutting edge tip 11 to cutting edge tip 12), the overall orientation of the main surface planes M1 and M2 and cutting edge surface 16 of the cutting edge 10 is parallel to the axis AX along which the chain extends.

Furthermore, with reference to FIG. 2*b*, even though the cutter bit holding members 3 at the left-most and right-most portions of base plate 2 in the plan view of FIG. 2*b* are oriented at an angle from the base plate 2, the orientation of the planes M1 and M2 and surface 16 of the cutting edge 10 of each of the three cutter bits 4 is parallel to the axis AX along which the chain extends.

Figure 2C:
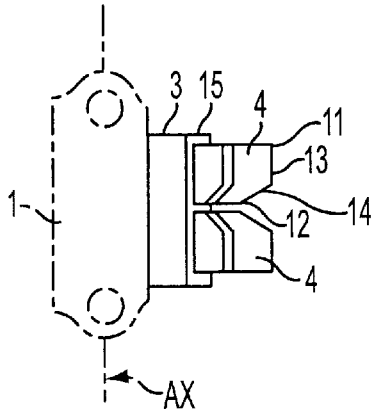
Figure 4:
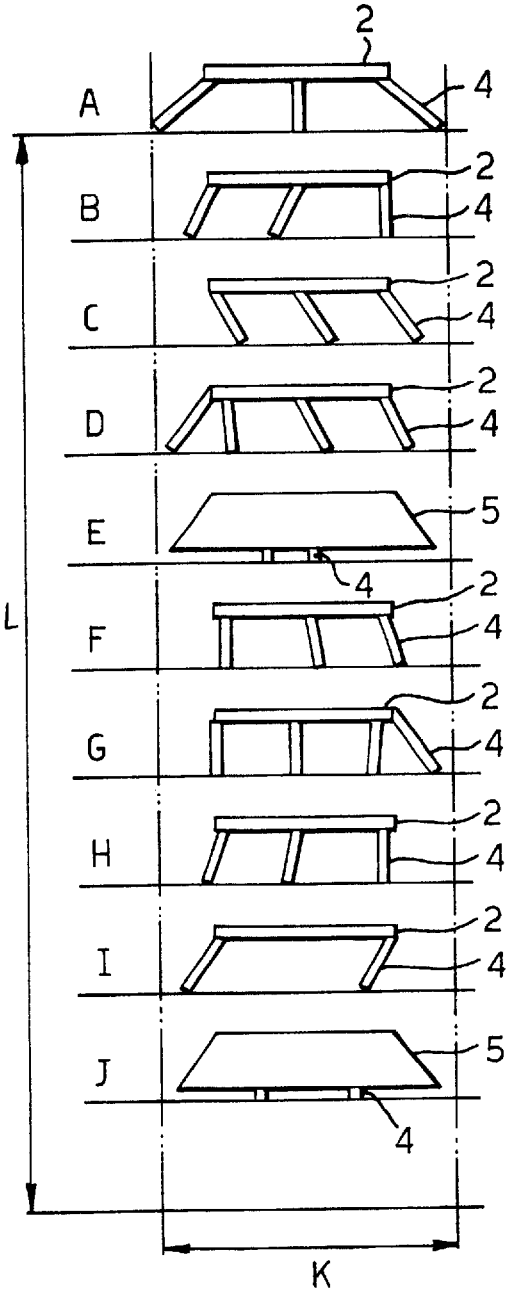
FIG. 4 is an explanatory view showing schematic plan views of the cutter elements of a group of cutter elements A–J, arranged in the order in which they are attached to the chain.
Figure 5:
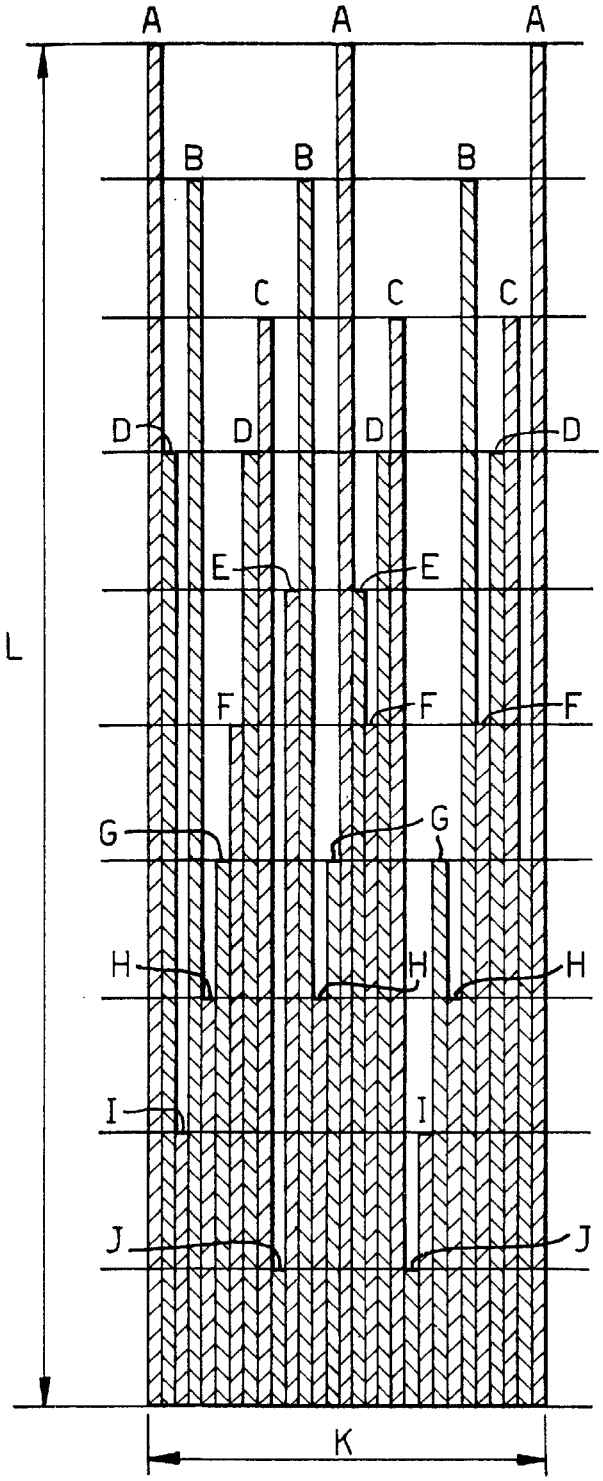
FIG. 5 is an explanatory view showing the excavating loci and progress along the cutter face of the various kinds of cutter elements of the group A–J, shown in FIG. 4.
Figure 6:
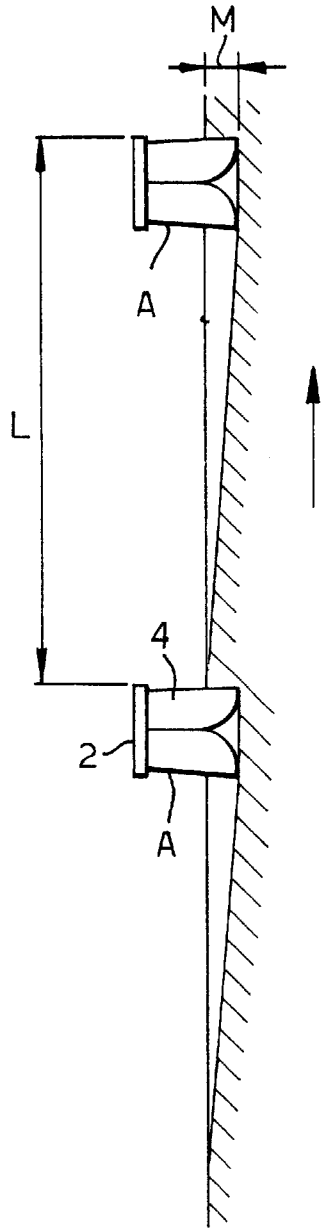
FIG. 6 is a sectional elevational view showing the cutting performed by corresponding cutter bits in adjacent groups.
Figure 7:
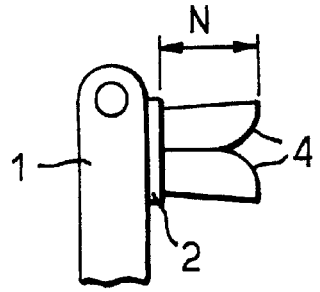
FIG. 7 is a schematic side view of a cutter element.
Figure 8:
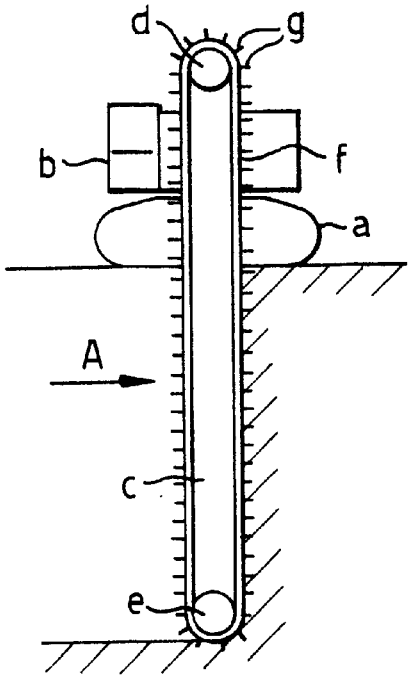
Fig.8. Prior Art
FIG. 8 is a schematic elevational view showing one example of an excavating apparatus for cutting ditches used in constructing underground continuous walls.
Figure 9:
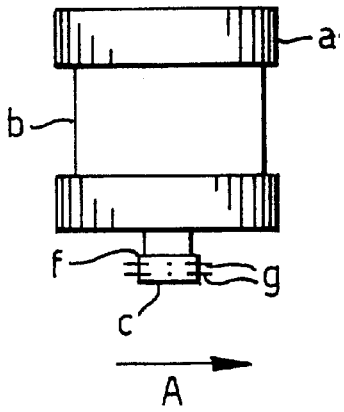
Fig.9. Prior Art
FIG. 9 is a schematic plan view of the apparatus of FIG. 8.
Figure 10:
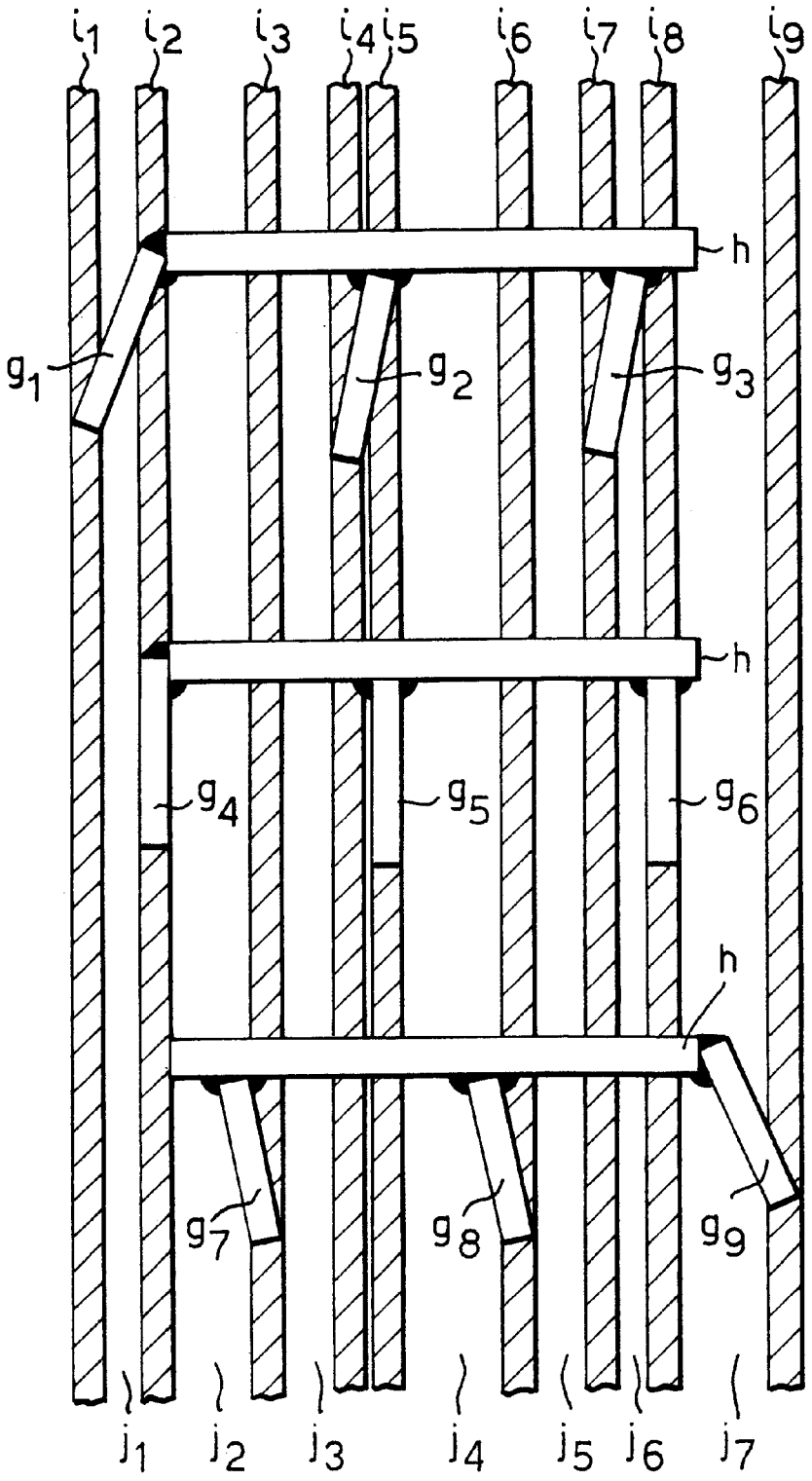
Fig.10. Prior Art
FIG. 10 is an explanatory view showing an arrangement of a prior endless chain type cutter and excavating loci thereof.

Cutter bit 4 depicted in side view in FIG. 2*c* is still another possible embodiment of the cutter bit depicted in FIG. 2*a*. In this embodiment, cutting edge 10 comprises cutting edge tip 11 and cutting edge tip 12, and further comprises two cutting edge sections 13 and 14, each of which includes a portion of cutting edge surface 16. First cutting edge section 13 is oriented so as to be parallel to the face 15 of cutter bit holding member 3, and second cutting edge section 14 is angled relative to face 15. As with the embodiment depicted in FIG. 2*a*, however, the overall orientation of the planes M1 and M2 and surface 16 of the cutting edge sections 13 and 14 is parallel to the axis AX along which the chain extends;

In FIG. 4 element A is shown in a schematic plan view. The other cutter elements B, C, D, F, G, H and I are also shown schematically in FIG. 4. Although the position and the angle of each of the cutter bits 4 are different from the cutter element A, they have essentially, the same construction as the cutter element A.

Figure 3A:
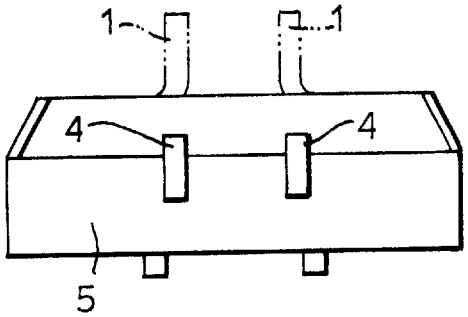
FIG. 3 shows at (a) a front view of another cutter element, and at (b) and (c) plan and side views of that element.
Figure 3B:
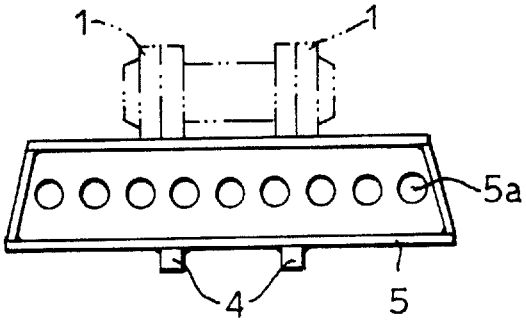
Figure 3C:
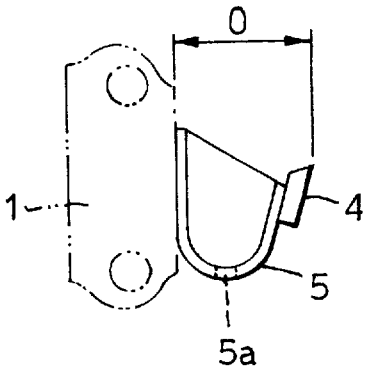

FIG. 3 shows a cutter element E. This comprises a bucket-type main body 5 attached to the outer side of the chain 1, and two cutter bits 4 disposed protrudingly on the outer side edge of the main body 5. At 5*a* are a plurality of holes made on a curved bottom wall of the main body 5. The cutter element J, also schematically shown, as is element E, in FIG. 4, has essentially the same construction as cutter element E, but the positions of the cutter bits 4 are different from those in the cutter element E.

Groups of cutter elements A–J are arranged continuously on the endless chain. The cutter bits 4 of each group of cutter elements A–J are arranged such that their respective excavating loci, which are shown by the correspondingly marked hatched lines in FIG. 5, cover the entire width K of the ditch.

In using the endless chain type cutter to excavate a ditch, the chain is driven between the upper and lower sprockets such that in a certain time it moves a distance L (refer to FIG. 5) corresponding to the length of a group of cutter elements A–J. In the method of the invention, in the same period of time, the chain cutter is advanced gradually horizontally through a distance M (refer to FIG. 6) into the ground being excavated. The distance M is made smaller than the distance N (refer to FIG. 7) by which the cutter bits 4 project from the base plate 2 of cutter elements A, B, C, D and F, G, H, I. The distance M is also smaller than the length O (refer to FIG. 3(*c*)) by which the bucket-type cutter elements E and J project forward from the chain 1.

As a result, even if the ground to be excavated is hard and strong, since the cutter bits 4 of a group of cutter elements cut the ground over the entire width of the excavated ditch, and since the horizontal distance advanced by the cutter when the same kind of cutter element comes up to the same vertical position in the ditch is smaller than the length N by which the cutter bits 4 protrude from the base plate 2, the outer surface of the base plate 2 and the chain 1 do not come into contact with the ground being excavated. The ground is loosened by all the elements A–J, while bucket-type elements E and J also collect and elevate to the surface, in order to be disposed of, ground which has been loosened.

In a typical example, the width K of the excavated ditch is 550 mm (about 1.8 feet), the length L of one group of cutter elements A–J attached to the chain is 4064 mm (about 13.3 feet), the horizontal distance M advanced by the cutter, when the cutter chain moves a distance L, is 11 mm (0.43 inches) and the maximum protruding length N of each cutter bits 4 on the base plates 2 of each cutter element A, B, C, D, F, G, H and I is 136 mm (5.4 inches).

I claim:

1. An endless chain type cutter comprising:

upper and lower sprockets spaced apart along a longitudinal axis;

an endless chain extending between the upper and lower sprockets along said axis; and at least one group of cutter elements, mounted on said endless chain, for cutting a ditch of predetermined width, at least some of said cutter elements having a planar configuration, a beveled cutting edge surface and a cutting edge, an entire longitudinal length of said planar configuration being oriented substantially parallel to said longitudinal axis and at least one of said beveled cutting edge surface and said cutting edge being oriented at an angle relative to said longitudinal axis, said at least one group of cutter elements including laterally outermost cutter elements spaced apart by said predetermined width, and the cutter elements of said at least one group together being arranged to cut throughout the predetermined width between the laterally outermost cutter elements of said at least one group.

2. An endless chain type cutter according to claim 1, wherein at least one cutter element of said at least one group includes a bucket.

3. An endless chain type cutter according to claim 2, wherein the bucket of said at least one cutter element has at least one cutter bit projecting therefrom.

4. An endless chain type cutter according to claim 1 including, in each group of cutter elements, main cutter elements which have a plurality of cutter bits projecting from base plates, said base plates being attached to the chain, said plurality of cutter bits comprising said cutting edges.

5. An endless chain type cutter according to claim 4, wherein at least some of said cutter bits of at least some of said main cutter elements project from the base plate outwards beyond lateral edges of the base plates.

6. Apparatus for excavating a ditch including a vehicle having mounted thereon an endless chain type cutter according to claim 1.

7. Apparatus according to claim 6, wherein said vehicle comprises at least one track for moving said vehicle.

8. An endless chain cutter according to claim 1, wherein said cutting edges have excavating loci which together extend across an entirety of said predetermined width.

* * * * *